US006767195B2

(12) United States Patent
Lee

(10) Patent No.: US 6,767,195 B2
(45) Date of Patent: Jul. 27, 2004

(54) VALVE FOR HERMETIC COMPRESSOR

(75) Inventor: Sung-tae Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 10/298,820

(22) Filed: Nov. 19, 2002

(65) Prior Publication Data

US 2003/0223895 A1 Dec. 4, 2003

(30) Foreign Application Priority Data

May 31, 2002 (KR) ..... 2002-30488

(51) Int. Cl.[7] ..... F04B 39/10; F04B 23/00; F04B 39/00; F16K 15/00

(52) U.S. Cl. ..... 417/569; 417/313; 417/566; 417/567; 137/512

(58) Field of Search ..... 417/DIG. 1, 542, 417/566, 567, 569, 571, 313; 132/512; 137/533, 533.19, 533.17

(56) References Cited

U.S. PATENT DOCUMENTS 1,610,869 A * 12/1926 Loranger et al. ..... 417/439
2,859,912 A * 11/1958 Swart et al. ..... 417/571
2,935,248 A * 5/1960 Gerteis ..... 417/564
4,275,759 A * 6/1981 Huang ..... 137/528
4,325,680 A * 4/1982 Bar ..... 417/569
4,911,614 A * 3/1990 Kawai et al. ..... 417/269
4,924,906 A * 5/1990 Hrabal ..... 137/512.1
5,709,535 A * 1/1998 Enomoto et al. ..... 417/269

* cited by examiner

*Primary Examiner*—Justin R. Yu
*Assistant Examiner*—Timothy P. Solak
(74) *Attorney, Agent, or Firm*—Plumsea Law Group, LLC

(57) ABSTRACT

A valve for a hermetic compressor has a valve plate disposed between a cylinder block and a cylinder head. The cylinder block has a cylinder, and the cylinder head has a refrigerant suction chamber and a refrigerant discharge chamber, which are partitioned from one another by a partition. The cylinder head further has at least first, second and third plates of different thicknesses, a refrigerant suction passage for interconnecting the refrigerant suction chamber and the cylinder; and a refrigerant discharge passage for interconnecting the refrigerant discharge chamber and the cylinder. A suction valve opens and closes the refrigerant suction passage while being moved by pressure in the cylinder; and a discharge valve opens and closes the refrigerant discharge valve while being moved by the pressure in the cylinder.

21 Claims, 7 Drawing Sheets

VALVE FOR HERMETIC COMPRESSOR

BACKGROUND OF THE INVENTION

Field of the Invention

The present invention generally relates to a compressor, and more particularly to a valve for a hermetic compressor.

FIG. 1 shows a typical example of a hermetic compressor. Referring to FIG. 1, a reference numeral 100 denotes a casing, 200 is an electronic component unit, and 300 is a compression unit for compressing refrigerant with power supplied from the electronic component unit 200.

As shown in FIG. 1, the casing 100 has upper and lower casings 110, 120, each of which has a substantially semi-circular shape. The upper and lower casings 110, 120 are coupled with each other, thereby defining a predetermined sealed space therewithin.

The electronic component unit 200 includes a stator 210 installed inside of the casing 100, a rotator 220 that rotates in electromagnetic interaction with the stator 210, and a rotary shaft 230 press-fit to the rotator 220. The rotary shaft 230 has an eccentric portion 231 provided at its lower end.

The compression component unit 300 includes a piston 310, a cylinder block 320, a cylinder head 330 and a valve device 340.

The piston 310 is linked to one end of a connecting rod 311, which is connected at its other end to eccentric portion 231 of the rotary shaft 230. The cylinder block 320 provides a cylinder 321, in which the piston 310 is positioned. Accordingly, as the rotary shaft 230 is rotated, the piston 310 reciprocates within the cylinder 321.

The cylinder head 330 is connected to the cylinder block 320. The cylinder head 330 has a refrigerant suctioning chamber 332 and a refrigerant discharge chamber 333, which are partitioned from each other by a partition 331. The refrigerant suctioning chamber 332 is connected to a suction muffler 350, while the refrigerant discharge chamber 333 is connected to a discharge muffler (not shown).

A valve 340 is disposed between the cylinder block 320 and the cylinder head 330, and as shown in FIG. 2, the valve 340 includes a valve plate 341, a suction valve 342 and a discharge valve 343.

The valve plate 341 has a refrigerant suctioning hole 341*a* and a refrigerant discharge hole 341*b* formed therein. As shown in FIG. 3, the cylinder 321 of the cylinder block 320 and the refrigerant suctioning chamber 332 of the cylinder head 330 are interconnected with each other via the refrigerant suction hole 341*a*, while the cylinder 321 of the cylinder block 320 and the refrigerant discharge chamber 333 of the cylinder head 330 are interconnected with each other via the refrigerant discharge hole 341*b*.

The suction valve 342 is disposed on the side of valve plate 341 closest to the cylinder block 320, to selectively open the refrigerant suction hole 341*a*. The suction valve 342 is formed by partially cutting a suction valve sheet 342*a* disposed between the cylinder block 320 and the valve plate 341.

The discharge valve 343 is disposed on the side of valve plate 341 closest to the cylinder head 330 to selectively open the refrigerant discharge hole 341*b*. At the rear portion of the discharge valve 343, a stopper 344 and a keeper 345 are formed in sequential order to restrict the listing of the discharge valve 343.

The suction valve 342 and the discharge valve 343 open or close the refrigerant suction hole 341*a* and the refrigerant discharge hole 341*b* by being moved by the pressure in the cylinder 321, thereby causing the refrigerant of the refrigerant suctioning chamber 332 to be drawn into the cylinder 321 or causing the refrigerant of the cylinder 321 to be discharged out to the refrigerant discharge chamber 333. Such operation of the conventional valve 340 will be described below in greater detail with reference to FIG. 3.

During the stroke of the piston 310 moving from its upper dead end to its lower dead end, the suction valve 342 is moved by reduced pressure in the cylinder 321 to the position indicated by the one-dot line of FIG. 3, thereby opening the refrigerant suction hole 341*a* and letting the refrigerant of the refrigerant suction chamber 332 to be drawn into the cylinder 321 through the open refrigerant suction hole 341*a*.

As the piston 310 is moved from its lower dead end to its upper dead end, the drawn refrigerant is compressed, and accordingly, the pressure in the cylinder 321 keeps increasing. At this time, the suction valve 342 is moved by the pressure in the cylinder 321 to the position indicated by the solid line of FIG. 3, thereby closing the refrigerant suction hole 341*a*.

As the piston 310 keeps moving to its upper dead end, the pressure in the cylinder 321 also keeps increasing. Then, as the piston 310 moves very close to its upper dead end, the pressure in the cylinder 321 has increased to the maximum extent, and accordingly, the discharge valve 343 is moved by the pressure in the cylinder 321 to the position indicated by the one-dot line of FIG. 3, thereby opening the refrigerant discharge hole 341*b*. As a result, the compressed refrigerant in the cylinder 321 is discharged to the refrigerant discharge chamber 333 of the cylinder head 330 through the refrigerant discharge hole 341*b*.

After reaching its upper dead end, the piston 310 is moved back to its lower dead end, and by the recovery force of the discharge valve 343, the discharge valve 343 is moved to the position indicated by the solid line of FIG. 3, closing the discharge hole 341*b*. Accordingly, as the pressure is produced in the cylinder 321, the refrigerant suction hole 341*a* is opened.

In the conventional valve for the hermetic compressor, when the suction valve 342 and the discharge valve 343 open and close, and especially when the discharge valve 343 closes the refrigerant discharge hole 341*b*, the discharge valve 343 strongly beats the valve plate 341 due to the recovery force of a neck 343*a* of the discharge valve 343 (see FIG. 2) and the recovery force of a bending portion 344*a* (see FIG. 2) of the stopper 344. The striking energy generated during the beating of the valve plate 341 is converted into an instantaneous mass energy by the uniform beating of the valve plate 341, and is then converted to vibration energy generating waves. Then, considerable noise is generated as the vibration energy is converted to negative pressure energy, generating sound waves in the air.

In the conventional valve for the hermetic compressor, additional parts like stopper 344 and the keeper 345 are employed to resiliently support the discharge valve 343 and to restrict the lifting of the discharge valve 343. Accordingly, the number of parts increases and the structure becomes complex.

Further, since a certain space has to be ensured for the stopper 344 and the keeper 345, the space for the cylinder head 330 and the refrigerant suction chamber 332 becomes narrower. Accordingly, the freedom in design is limited, like the design of the refrigerant suction hole 341*a* and the discharge hole 341*b*.

SUMMARY OF THE INVENTION

Accordingly, it is an object of the present invention to provide a valve for a hermetic compressor capable of reducing a noise of the compressor by preventing the noise generating source, i.e., by reducing sound pressure energy coming from striking energy generated during the beating of a discharge valve on a valve plate, using sound transmission loss through a partition, which is obtained from a boundary interference between different mediums.

Another object is to provide a valve for a hermetic compressor contributing to a simpler construction with a smaller number of parts and the largest-possible space for a cylinder head, where the simpler construction is obtained by opening and closing a refrigerant discharge hole with the movement of a discharge valve in a certain space by the pressure of a cylinder, thereby omitting the need for parts like a stopper and keeper for supporting the discharge valve.

The above objects are accomplished by a valve for a hermetic compressor according to the present invention, including a valve plate disposed between a cylinder block and a cylinder head, the cylinder block having a cylinder, the cylinder head having a refrigerant suction chamber and a refrigerant discharge chamber, which are partitioned from each other by a partition, the valve plate comprising at least first, second and third plates of different thicknesses, a refrigerant suction passage for interconnecting the refrigerant suction chamber and the cylinder; and a refrigerant discharge passage for interconnecting the refrigerant discharge chamber and the cylinder, a suction valve for opening/closing the refrigerant suction passage while being moved by a pressure in the cylinder; and a discharge valve for opening/closing the refrigerant discharge valve while being moved by the pressure in the cylinder.

The first through third plates may be formed of metals of different densities. The plates may be formed of non-metals of different densities. One of the plates may be formed of a metal, while the other plates are formed of non-metals of different densities.

According to a preferred embodiment of the present invention, the refrigerant suction passage comprises: a first refrigerant suction hole formed in a first plate having a predetermined diameter; a second refrigerant suction hole formed in a second plate having a diameter narrower than the diameter of the first refrigerant suction hole; and a third refrigerant suction hole formed in the third plate and having a diameter identical to the diameter of the first refrigerant suction hole. The refrigerant discharge passage comprises: a first refrigerant discharge hole formed in the first plate and having a predetermined diameter; a second refrigerant discharge hole formed in the second plate, the second refrigerant discharge hole comprising a guide portion having a diameter greater than the diameter of the first refrigerant discharge hole, and a discharge portion partially overlapping so as to be interconnected with the guide portion; and a third refrigerant discharge hole eccentrically formed away from the first refrigerant discharge hole in a manner so as to interconnect with the discharge portion of the second refrigerant discharge hole.

The discharge valve is movably disposed inside of the guide portion of the second refrigerant discharge hole to open and close the first refrigerant discharge hole. The discharge valve is formed of a circular plate having a thickness greater than the thickness of the second valve plate, and having a diameter greater than the diameter of the first refrigerant discharge hole and smaller than the diameter of the guide portion.

According to another preferred embodiment of the present invention, the plates have one or more holes of different sizes and shapes for regulating an impedance of sound waves generated by the respective plates.

BRIEF DESCRIPTION OF THE DRAWINGS

The above-mentioned objects and the feature of the present invention will be more apparent by describing the preferred embodiment of the present invention in detail referring to the appended drawings, in which.

DETAILED DESCRIPTION OF PREFERRED EMBODIMENTS

Figure 1:
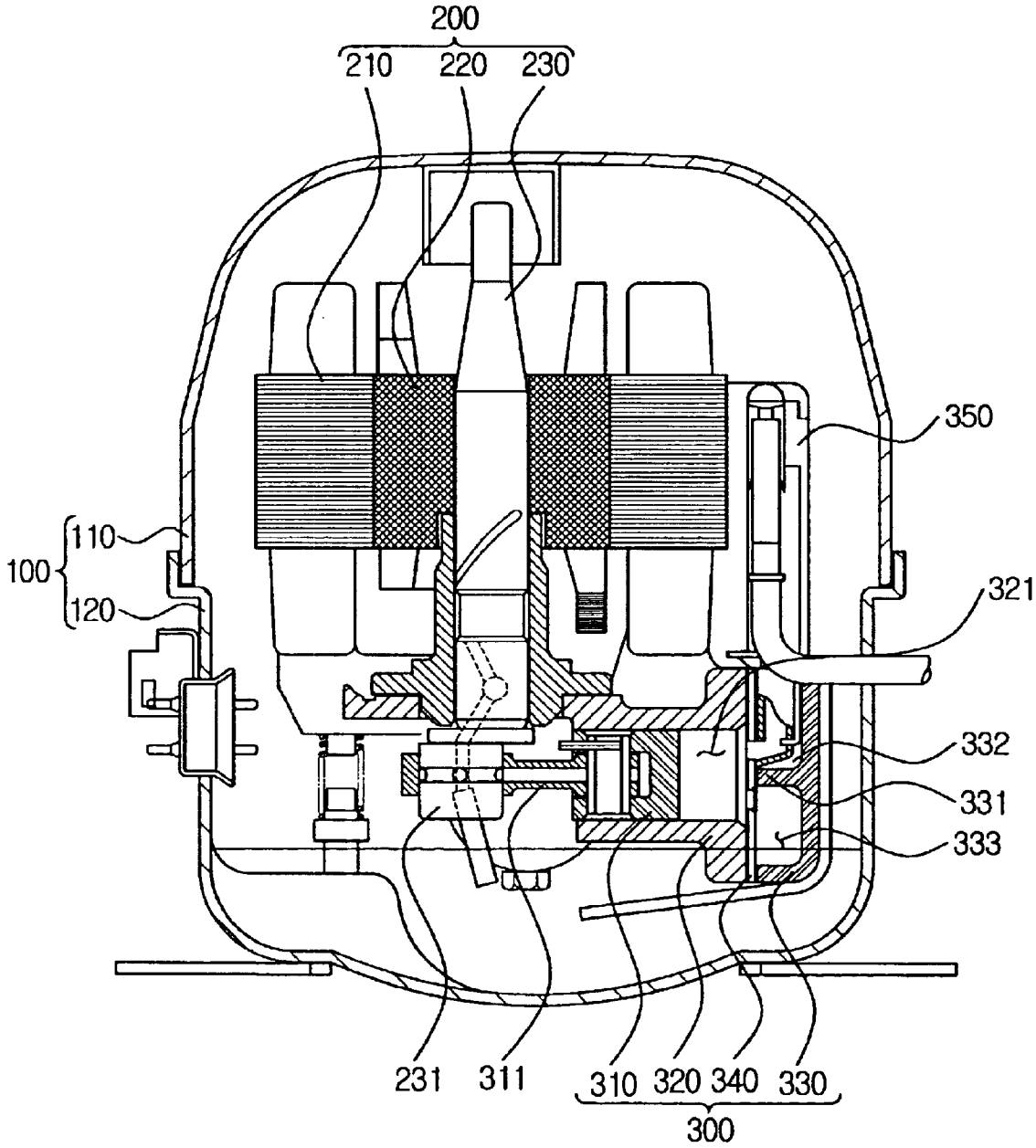
FIG. 1 (PRIOR ART)
FIG. 1 is a sectional view schematically showing a conventional hermetic compressor.
Figure 2:
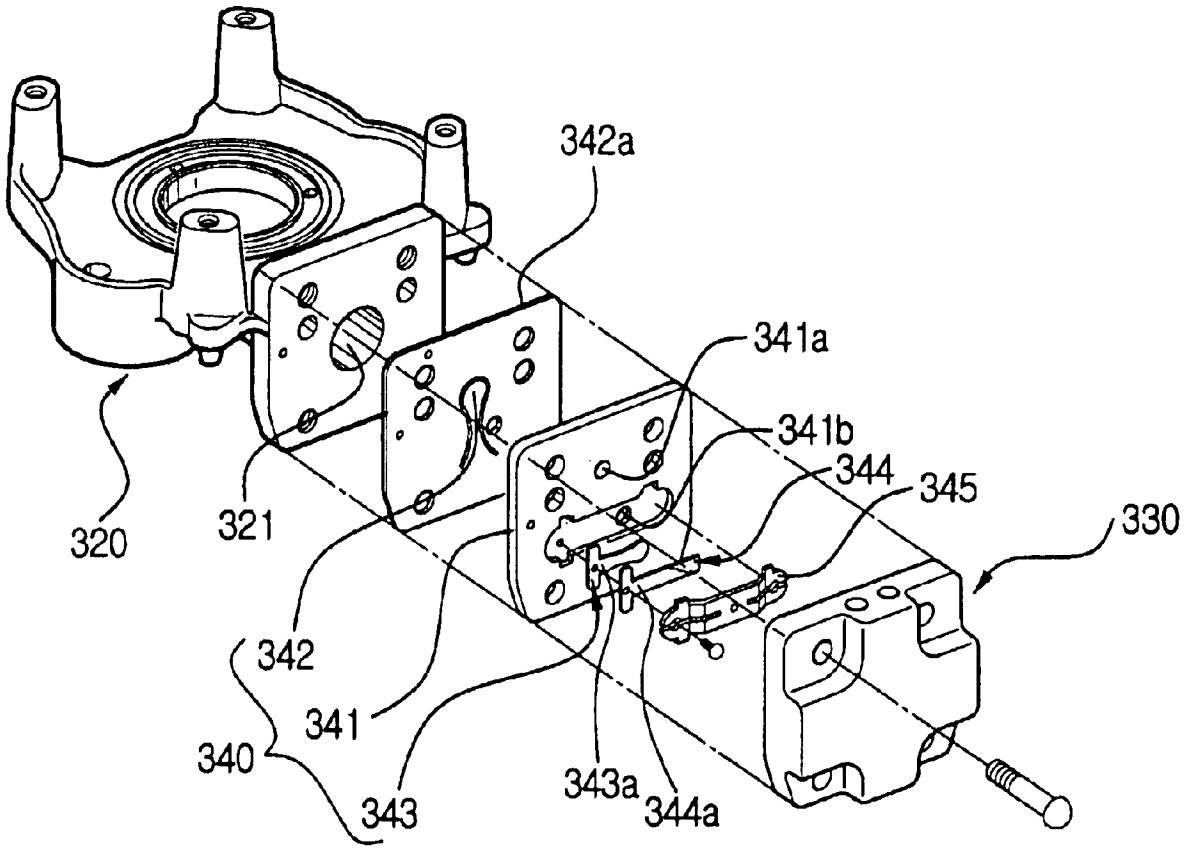
FIG.2 (PRIOR ART)
FIG. 2 is an exploded perspective view of a conventional valve of the compressor of FIG. 1.
Figure 3:
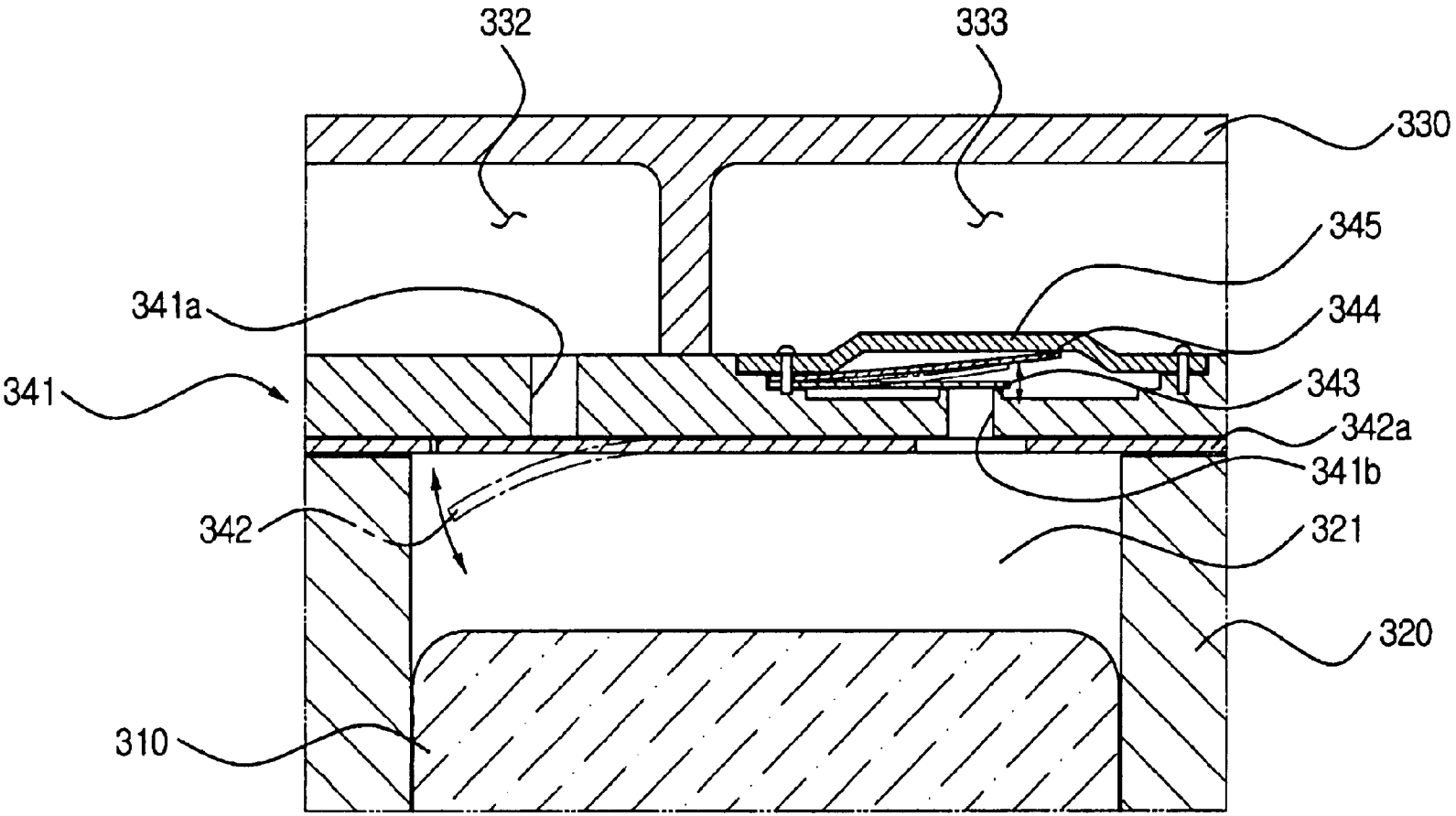
FIG.3 (PRIOR ART)
FIG. 3 is a sectional view showing the operation of the conventional valve of FIG. 2.

The present invention will be described in greater detail with reference to the accompanying drawings. Throughout the description, like elements with similar functions will be given the same reference numerals.

Figure 4:
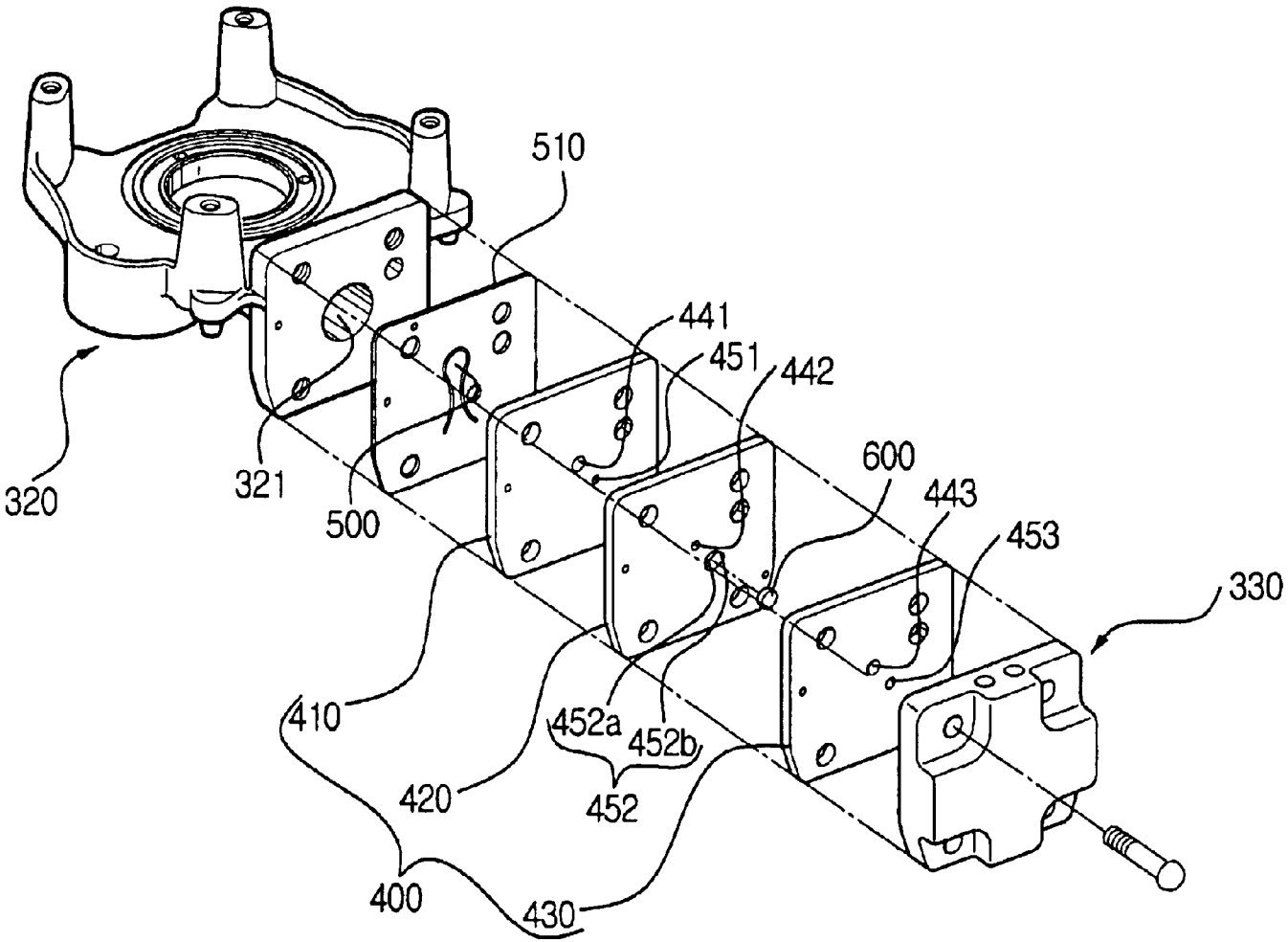
FIG. 4 is an exploded perspective view of a valve for a hermetic compressor according to a preferred embodiment of the present invention.
Figure 5:
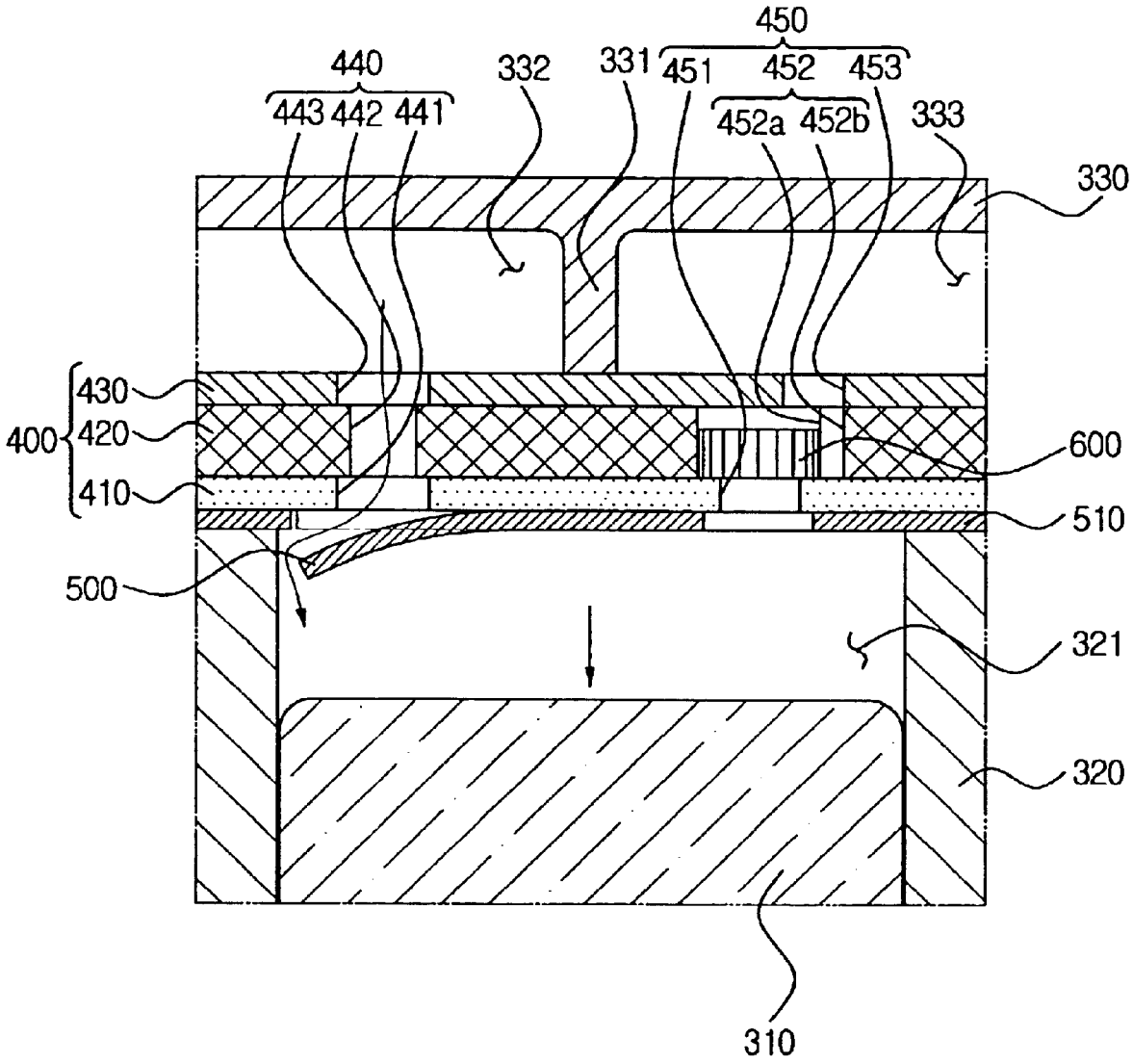
FIGS. 5 and 6 are sectional views showing the operations of the valve for the hermetic compressor according to the preferred embodiment of the present invention.
Figure 6:
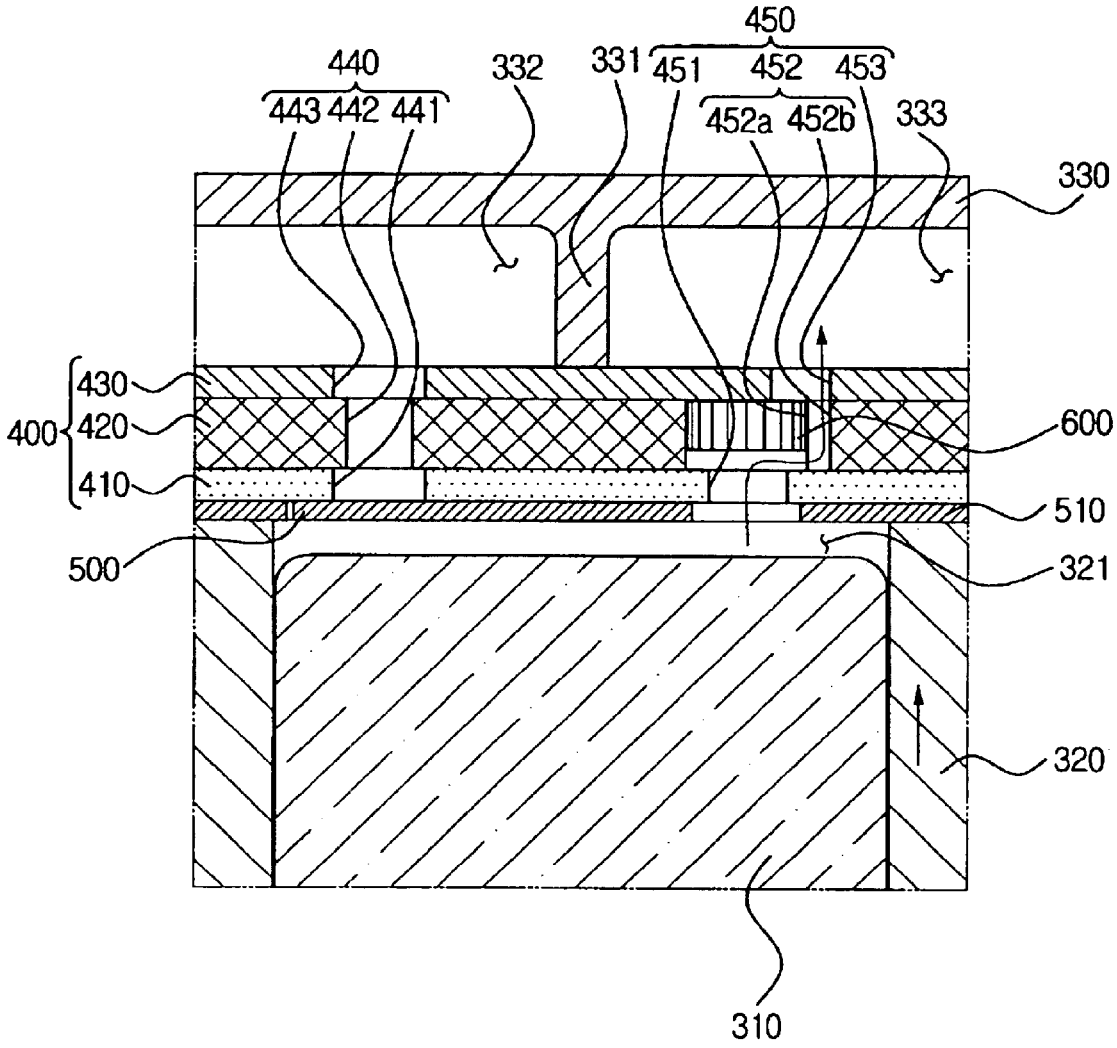

Referring to FIGS. 4 through 6, a valve for a hermetic compressor according to the first preferred embodiment of the present invention includes a valve plate 400, a suction valve 500 and a discharge valve 600.

The valve plate 400 is disposed between a cylinder block 320 and a cylinder head 330. The valve plate 400 has first through third independent plates 410, 420, 430, each of which is constructed according to the aspects of the present invention. The three plates 410, 420, 430 have different thicknesses, respectively. More preferably, the plates 410, 420, 430 are formed of metals or non-metals having different densities, respectively. All of the plates 410, 420, 430 can be made of metals, or all can be made of non-metals. Alternatively, one plate can be made of metal, while the others are made of non-metals. Or, one can be made of non-metal, while the others are made of metals. Through experimentation, the thicknesses and materials of the plates 410, 420, 430 that could best achieve the objects and features of the present invention can be determined. In other words, the thicknesses and the materials of the plates 410, 420, 430 that could reduce the noise as low as possible can be determined. Each of the plates 410, 420, 430 has very precise surface roughness, and thus, it does not permit the refrigerant to leak through the joining area. However, a gasket can be disposed in the joining area of the plates 410, 420, 430 for an even higher level of air-tightness.

The valve plate 400 has a refrigerant suction passage 440 and a refrigerant discharge passage 450. As shown in FIGS. 5 and 6, the cylinder 321 of the cylinder block 320 is interconnected with the refrigerant suction chamber 332 of the cylinder head 330 through the refrigerant suction passage 440, while the cylinder 321 of the cylinder block 320 is interconnected with the refrigerant discharge chamber 333 of the cylinder head 330 through the refrigerant discharge passage 450.

The refrigerant suction passage 440 has first through third refrigerant suction holes 441, 442, 443 formed at certain locations of first through third plates 410, 420, 430. The first refrigerant suction hole 441 is formed on the first plate 410, with a predetermined diameter. The second refrigerant suction hole 442 is formed on the second plate 420, with a smaller diameter than the diameter of the first refrigerant suction hole 441. The third refrigerant suction hole 443 is formed on the third plate 430, with a diameter identical to the diameter of the first refrigerant suction hole 441. The first through third refrigerant suction holes 441, 442, 443 are arranged concentrically, with the second refrigerant suction hole 442 having a smaller diameter than the diameters of the other suction holes 441, 443. Accordingly, the refrigerant drawn into the cylinder 321 along the refrigerant suction passage 440 will undergo repeated contraction and expansion. As a result, pulsation of the refrigerant can be reduced.

The refrigerant discharge passage 450 has first through third refrigerant discharge holes 451, 452, 453 formed at certain locations of the first through third plates 410, 420, 430. The first refrigerant discharge hole 451 is formed on the first plate 410, with a predetermined diameter. The second refrigerant discharge hole 452 is formed on the second plate 420, and has a guide portion 452*a* having a larger diameter than the diameter of the first refrigerant discharge hole 451, and a discharge portion 452*b* partially overlapping and interconnected with the guide portion 452*a*. The third refrigerant discharge hole 453 is formed on the third plate 430, and is eccentrically positioned away from the first refrigerant discharge hole 451 by a predetermined distance and interconnected with the discharge portion 452*b* of the second refrigerant discharge hole 452. Here, the diameter of the discharge portion 452*b* of the second refrigerant discharge hole 452 is smaller than the diameters of the first refrigerant discharge hole 451 of the third refrigerant discharge hole 453. Accordingly, the refrigerant discharged into the refrigerant discharge chamber 333 of the cylinder head 330 through the refrigerant discharge passage 450 undergoes repetitive expansion and contraction. Accordingly, the pulsation of the discharge refrigerant can be reduced.

The suction valve 500 is positioned on the first plate 410, to cover the first refrigerant suction hole 441 of the first plate 410. The suction valve 500 can be defined by partially cutting a suction valve sheet 510, which is disposed between the first plate 410 and the cylinder block 320.

The discharge valve 600 is movably disposed in the guide portion 452*a* of the second refrigerant discharge hole 452 of the second plate 420. The discharge valve 600 has a diameter larger than the diameter of the first refrigerant discharge hole 451, and smaller than the diameter of the guide portion 452*a*. The discharge valve 600 is formed of a circular plate, having a smaller thickness than the thickness of the second plate 420. Accordingly, the discharge valve 600 can open and close the first refrigerant discharge hole 451 by moving inside the guide portion 452*a*.

In the valve constructed as described above, both the suction valve 500 and the discharge valve 600 are moved by the pressure changes in the cylinder 321, selectively opening and closing the refrigerant suction passage 440 and the refrigerant discharge passage 450. Accordingly, the flow of the refrigerant is controlled, so that the refrigerant is drawn into the cylinder 321 from the refrigerant suction chamber 332 during the suction stroke, while the refrigerant is discharged from the cylinder 321 to the refrigerant discharge chamber 333 during the discharge stroke.

The operations of the valve according to the present invention will be described below in greater detail with reference to FIGS. 5 and 6.

FIG. 5 shows the suction stroke. In the suction stroke, the piston 310 is moved toward the lower dead end of the cylinder 321, accordingly producing a reduced pressure in the cylinder 321. As the pressure is reduced in the cylinder 321, the suction valve 500 is moved to the position indicated by the solid line of FIG. 5, opening the refrigerant suction passage 440 and thus permitting the refrigerant from the refrigerant suction chamber 332 to be drawn into the cylinder 321 through the open refrigerant suction passage 440. This continues until the piston 310 reaches the lower dead end, and in this situation, the discharge valve 600 is moved to a position at the lower end of the guide portion 452*a*, closing the refrigerant discharge passage 450.

FIG. 6 shows the refrigerant compression and discharge stroke, in which the piston 310 is moved from the lower dead end toward the upper dead end. As the piston 310 is moved toward the upper dead end, the refrigerant in the cylinder 321 is compressed, generating high pressure in the cylinder 321. Due to the high pressure in the cylinder 321, the suction valve 500 of FIG. 6 closes the refrigerant suction passage 440, with the discharge valve 600 and the refrigerant discharge passage 450 also being closed. As the refrigerant is continuously compressed, the pressure grows, and as the piston 310 gets close to the upper dead end, the pressure grows to its maximum level. In such a situation, the discharge valve 600 is moved upward from the guide portion 452*a* by the pressure in cylinder 321, letting the first refrigerant discharge hole 451 and the discharge portion 452*b* of the second refrigerant discharge hole 452 become interconnected with each other. As the first refrigerant discharge hole 451 and the discharge portion 452*b* of the second refrigerant discharge hole 452 are interconnected, they are opened, and the compressed refrigerant is discharged through the opened discharge passage 450 to the refrigerant discharge chamber 333.

Then, as the piston 310 moves from the upper dead end to the lower dead end, the suction stroke described above is repeated. Through the repeated suction and discharge strokes of the piston 310, the refrigerant is compressed and discharged.

According to the present invention, the valve plate 400 has the three independent plates 410, 420, 430 that have different thicknesses and densities. Accordingly, the noise due to the beatings of the suction valve 500 or the discharge valve 600 onto the valve plate 400 can be reduced. As mentioned above, during the operation of the suction valve 500 or the discharge valve 600, the striking energy from the beating of the valves 500, 600 against the valve plate 400 is converted to vibration energy, and then to sound pressure energy from which sound waves are generated. According to the present invention, the noise from the sound waves can be prevented due to the principle of transmission loss through the partition by the boundary interferences between the respective plates 410, 420, 430. Further, when the valve plate is constructed of plates of different thicknesses and densities, sound waves are generated from the respective plates with different speed of incident, reflection and transmission. Accordingly, the transmission or reflection with respect to the incident sound waves is within the extent that is dominated by impedance of the respective plates according to the type of materials, and as the frequency can be controlled effectively, the noise level can be reduced greatly.

Further, according to the present invention, as the discharge valve 600 is moved within a predetermined space, i.e., within the guide portion 452*a* of the second plate 420 to open and close the refrigerant discharge passage 450 simply by the pressure of the cylinder 321 and without requiring additional parts, the space for the refrigerant suction chamber 332 and the discharge chamber 333 is ensured sufficiently, and the discharge passage 450 can be designed to have various positions and shapes.

Figure 7:
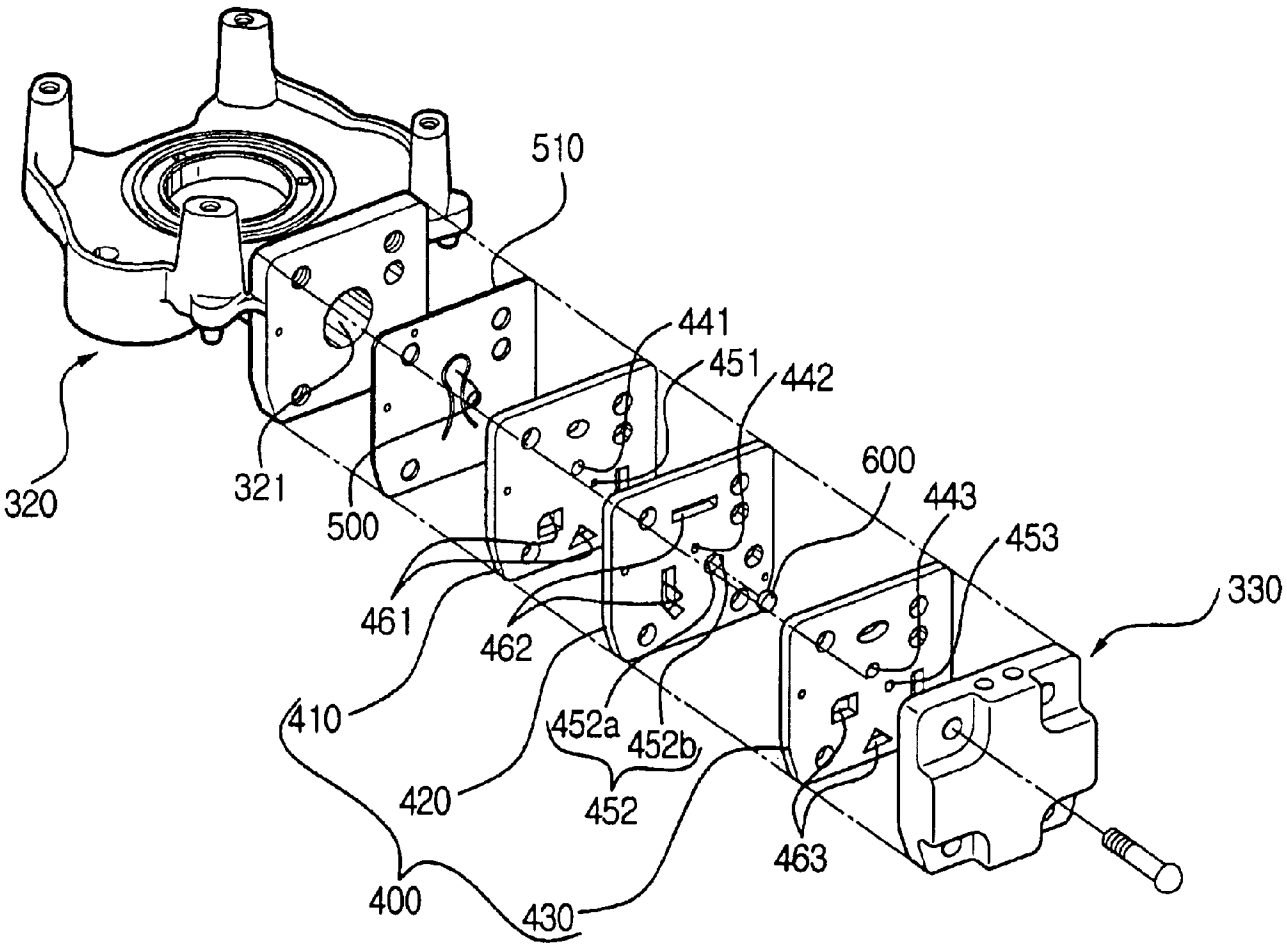
FIG. 7 is an exploded perspective view of a valve for a hermetic compressor according to another preferred embodiment of the present invention.

FIG. 7 is a view showing the valve for the hermetic compressor according to the second preferred embodiment of the present invention.

As shown in FIG. 7, the basic construction of the valve according to the second preferred embodiment of the present invention is identical to the construction of the valve according to the first preferred embodiment. Accordingly, description of the same elements will be omitted here, while the focus will be made on the unique feature of the second preferred embodiment, which is that the respective plates 410, 420, 430 have at least one hole 461, 462, 463 of different sizes and different shapes.

The respective holes 461, 462, 463 are aimed to regulate the impedance of the sound waves, which are generated according to the respective materials of the plates 410, 420, 430. By varying the size, number and shape of the holes 461, 462, 463, the impedance of the respective plates 410, 420, 430 can be regulated, and accordingly, the valve can be designed in a manner that it avoids resonance with the inner parts of the compressor. In other words, the respective plates can be regulated to have different impedances with minimum noise levels. Accordingly, by designing the plates according to the conditions that are obtained through experiments, the noise level can be reduced.

As described above, according to the present invention, the valve plate is made of three independent metal or non-metal plates of different thicknesses or different densities. Accordingly, the sound pressure energy generated by the vibration energy from the beating of the suction and discharge valves against the valve plate is reduced by the transmission loss through the partitions due to the boundary interferences among the plates. As a result, the noise from the compression in operation can be reduced.

Further, according to the present invention, the discharge valve opens and closes the refrigerant discharge passage by being moved in a certain space provided by the guide portion of the second refrigerant discharge hole of the second plate. Accordingly, there is no need to use additional parts like a stopper or keeper to support the discharge valve, and the construction of the valve can be simplified. Further, as the space for the suction chamber and the discharge chamber can be ensured sufficiently, there is greater freedom in designing and positioning the suction hole and the discharge hole.

Although the preferred embodiments of the present invention have been described, it will be understood by those skilled in the art that the present invention should not be limited to the described preferred embodiments, and various changes and modifications can be made within the spirit and scope of the present invention as defined by the appended claims.

What is claimed is:

1. A valve for hermetic compressor, comprising:

a cylinder block having a cylinder formed therein, a cylinder head having a refrigerant suction chamber and refrigerant discharge chamber, which are partitioned from each other by a partition;

a valve plate disposed between the cylinder block and the cylinder head;

the valve plate comprising at least first, second and third plates, each plate having a thickness different than each of the other plates and a material density different than each of the other plates;

a refrigerant suction passage interconnecting the refrigerant suction chamber and the cylinder; and a refrigerant discharge passage interconnecting the refrigerant discharge chamber and the cylinder;

a suction valve configured to open and close the refrigerant suction passage while being moved by pressure in the cylinder; and a discharge valve configured to open and close the refrigerant discharge valve while being moved by pressure in the cylinder.

2. The valve of claim 1, wherein each plate is formed of a metal and has a density different than a density of each of the other plates.

3. The valve of claim 1, wherein each plate is formed of a non-metal and has a density different than a density of each of the other plates.

4. The valve of claim 1, wherein one of the plates is formed of a metal, and each of the other plates is formed of a non-metal having a density different than a density of each of the other plates formed of a non-metal.

5. The valve of claim 1, wherein one of the plates is formed of a non-metal, while each of the other plates is formed of a metal having a density different than a density of each of the plates formed of metal.

6. The valve of claim 1, wherein the refrigerant suction passage comprises:

a first refrigerant suction hole formed in the first plate and having a predetermined diameter;

a second refrigerant suction hole formed in the second plates and having a diameter smaller than the diameter of the first refrigerant suction hole; and a third refrigerant suction hole formed in the third plate and having a diameter identical in size to the diameter of the first refrigerant suction hole.

7. The valve of claim 1, wherein the refrigerant discharge passage comprises:

a first refrigerant discharge hole formed in the first plate and having a predetermined diameter;

a second refrigerant discharge hole formed in the second plate, the second refrigerant discharge hole comprising a guide portion having a diameter greater than the diameter of the first refrigerant discharge hole, and a discharge portion partially overlapping and interconnected with the guide portion; and a third refrigerant discharge hole formed in the third plate eccentrically away from the first refrigerant discharge hole and interconnected with the discharge portion of the second refrigerant discharge hole, the discharge valve movably disposed inside of the guide portion of the second refrigerant discharge hole to open and close the first refrigerant discharge hole.

8. The valve of claim 1, wherein the refrigerant suction passage comprises:

a first refrigerant suction hole formed in the first plate and having a predetermined diameter;

a second refrigerant suction hole formed in the second plate and having a diameter smaller than the diameter of the first refrigerant suction hole; and a third refrigerant suction hole formed in the third plate and having a diameter identical in size to the diameter of the first refrigerant suction hole, and the refrigerant discharge passage comprises a first refrigerant discharge hole formed in the first plate and having a predetermined diameter;

a second refrigerant discharge hole formed in the second plate, the second refrigerant discharge hole comprising a guide portion having a diameter greater than the diameter of the first refrigerant discharge hole, and a discharge portion partially overlapping and interconnected with the guide portion; and a third refrigerant discharge hole eccentrically formed away from the first refrigerant discharge hole and interconnected with the discharge portion of the second refrigerant discharge hole, the discharge valve movably disposed inside of the guide portion of the second refrigerant discharge hole to open and close the first refrigerant discharge hole.

9. The valve of claim 8, wherein the discharge valve is formed of a circular plate having a thickness greater than the thickness of the second valve plate, and having a diameter greater than the diameter of the first refrigerant discharge hole and smaller than the diameter of the guide portion.

10. The valve of claim 1, wherein the plates have one or more holes of different sizes and shapes for regulating an impedance of sound waves generated from the respective plates.

11. The valve of claim 1, wherein the suction valve is defined by a partial cut formed in a suction valve sheet that is disposed between the first plate and the cylinder block.

12. A valve for a hermetic compressor, comprising:

a cylinder block defining a cylinder;

a piston reciprocatingly disposed in the cylinder;

a cylinder head having a partition defining a refrigerant suction chamber and a refrigerant discharge chamber;

a valve plate disposed between the cylinder block and the cylinder head;

the valve plate comprising three plates, each plate having a thickness different than each of the other plates and a material density different than each of the other plates;

a refrigerant suction passage interconnecting the refrigerant suction chamber and the cylinder and comprising three holes, each of the holes being formed in one of the three plates; and a refrigerant discharge passage interconnecting the refrigerant discharge chamber and the cylinder and comprising three holes, each of the holes being formed in one of the three plates;

a suction valve configured to open and close the refrigerant suction passage while being moved by pressure in the cylinder; and a discharge valve positioned in the refrigerant discharge passage and configured to open and close the refrigerant discharge valve while being moved by pressure in the cylinder.

13. The valve of claim 12, wherein the refrigerant suction passage comprises:

a first refrigerant suction hole formed in a first of the three plates and having a predetermined diameter;

a second refrigerant suction hole formed in a second of the three plates and having a diameter smaller than the diameter of the first refrigerant suction hole; and a third refrigerant suction hole formed in a third of the three plates and having a diameter equal to the diameter of the first refrigerant suction hole.

14. The valve of claim 12, wherein the refrigerant discharge passage comprises:

a first refrigerant discharge hole formed in a first of the three plates and having a predetermined diameter;

a second refrigerant discharge hole formed in a second of the three plates and comprising a guide portion having a diameter greater than the diameter of the first refrigerant discharge hole, and a discharge portion partially overlapping and interconnected with the guide portion; and a third refrigerant discharge hole formed in a third of the three plates eccentrically away from the first refrigerant discharge hole and interconnected with the discharge portion of the second refrigerant discharge hole, wherein the discharge valve is movably disposed inside of the guide portion of the second refrigerant discharge hole to open and close the first refrigerant discharge hole.

15. The valve of claim 14, wherein the discharge valve is formed of a circular plate having a thickness greater than the thickness of the second plate, and having a diameter greater than the diameter of the first refrigerant discharge hole and smaller than the diameter of the guide portion.

16. The valve of claim 12, wherein each plate is formed of a metal and has a density different than a density of each of the other plates.

17. The valve of claim 12, wherein each plate is formed of a non-metal and has a density different than a density of each of the other plates.

18. The valve of claim 12, wherein one of the plates is formed of a metal, and each of the other plates is formed of a non-metal having a density different than a density of each of the other plates formed of a non-metal.

19. The valve of claim 12, wherein one of the plates is formed of a non-metal, and each of the other plates is formed of a metal having a density different than a density of each of the plates formed of metal.

20. The valve of claim 12, wherein each of the plates has one or more additional holes of different sizes and shapes for regulating an impedance of sound waves generated from the respective plates.

21. The valve of claim 12, wherein the suction valve is defined by a partial cut formed in a suction valve sheet that is disposed between the first plate and the cylinder block.

* * * * *